US009815272B2

(12) United States Patent
Chiwata

(10) Patent No.: US 9,815,272 B2
(45) Date of Patent: Nov. 14, 2017

(54) INK JET RECORDING APPARATUS AND INK JET RECORDING METHOD

(71) Applicant: FUJIFILM Corporation, Tokyo (JP)

(72) Inventor: Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/415,965

(22) Filed: Jan. 26, 2017

(65) Prior Publication Data

US 2017/0129258 A1 May 11, 2017

Related U.S. Application Data

(63) Continuation of application No. PCT/JP2015/062351, filed on Apr. 23, 2015.

(30) Foreign Application Priority Data

Sep. 1, 2014 (JP) ..... 2014-176729

(51) Int. Cl.
*B41J 11/00* (2006.01)
*B41J 2/01* (2006.01)
(Continued)

(52) U.S. Cl.
CPC ..... *B41J 2/01* (2013.01); *B41J 11/002* (2013.01); *B41J 11/0085* (2013.01);
(Continued)

(58) Field of Classification Search
CPC ..... B41J 2/01; B41J 13/0009; B41J 11/002; B41J 13/22; B41J 11/0085; B65H 5/08; B41M 5/00
See application file for complete search history.

(56) References Cited

U.S. PATENT DOCUMENTS 9,233,534 B2 1/2016 Koga et al.
2009/0085998 A1* 4/2009 Kubota ..... B41J 11/002 347/102
(Continued)

FOREIGN PATENT DOCUMENTS

CN 102950886 A 3/2013
JP 2011-173337 A 9/2011
(Continued)

OTHER PUBLICATIONS

International Search Report issued in PCT/JP2015/062351; dated Jul. 7, 2015.
(Continued)

*Primary Examiner* — Manish S Shah
*Assistant Examiner* — Yaovi M Ameh
(74) *Attorney, Agent, or Firm* — Studebaker & Brackett PC

(57) ABSTRACT

The ink jet recording apparatus includes: transport means that transports paper having a recording surface, on which an image is formed using an aqueous ink, along a transport path; heating means that is provided along the transport path; guide means that is provided along the transport path and supports the paper using a guide surface having suction holes; and suction means that suctions the paper through the suction holes of the guide surface, a suction region and a non-suction region are set when the paper is transported, the suction region in which the paper is suctioned by the suction means is set upstream of a first position of the transport path, the non-suction region is set downstream of the first position, and the first position is set at a position in which a residual water content in the paper is 1.0 g/m$^2$ to 3.0 g/m$^2$.

11 Claims, 7 Drawing Sheets

(51) Int. Cl.

| | |
|---|---|
| ***B41M 5/00*** | (2006.01) |
| ***B65H 5/08*** | (2006.01) |
| ***B41J 13/00*** | (2006.01) |
| ***B41J 13/22*** | (2006.01) |

(52) U.S. Cl.
CPC ..... *B41J 13/0009* (2013.01); *B41J 13/22* (2013.01); *B41M 5/00* (2013.01); *B65H 5/08* (2013.01)

(56) References Cited

U.S. PATENT DOCUMENTS

| | | | | |
|---|---|---|---|---|
| 2009/0251522 | A1* | 10/2009 | Koike | B41J 11/002 347/104 |
| 2012/0098882 | A1 | 4/2012 | Onishi et al. | |
| 2012/0154498 | A1 | 6/2012 | Chiwata | |
| 2012/0229581 | A1 | 9/2012 | Kobayashi | |
| 2012/0314013 | A1 | 12/2012 | Takemoto et al. | |
| 2013/0044170 | A1* | 2/2013 | Chiwata | B41J 11/0015 347/102 |
| 2013/0162712 | A1 | 6/2013 | Yamanobe | |

FOREIGN PATENT DOCUMENTS

| | | | |
|---|---|---|---|
| JP | 2012-091342 | A | 5/2012 |
| JP | 2012-126057 | A | 7/2012 |
| JP | 2012-183804 | A | 9/2012 |
| JP | 2013-060302 | A | 4/2013 |
| JP | 2013-129111 | A | 7/2013 |
| JP | 2013-184327 | A | 9/2013 |
| JP | 2014-073658 | A | 4/2014 |

OTHER PUBLICATIONS

Written Opinion issued in PCT/JP2015/062351; dated Jul. 7, 2015.
An Office Action issued by the Chinese Patent Office (SIPO) dated Aug. 2, 2017, which corresponds to Chinese Patent pplication No. 201580044527.7 and is related to U.S. Appl. No. 15/415,965; with English language translation.

* cited by examiner

| | RESIDUAL WATER CONTENT ($g/m^2$) | | |
|---|---|---|---|
| TIME (sec) | PAPER I | PAPER II | PAPER III |
| 0 | 7.5 | 7.5 | 7.5 |
| 1 | 3.0 | 3.3 | 4.8 |
| 2 | 1.2 | 1.4 | 2.8 |
| 3 | 0.5 | 0.7 | 1.8 |
| 4 | 0 | 0.2 | 1.0 |
| 5 | −0.3 | −0.1 | 0.5 |
| 6 | −0.5 | −0.3 | 0.2 |

FIG. 8

| KIND | IRDuty | SUCTION STOP POSITION | RESIDUAL WATER CONTENT AT SUCTION STOP POSITION ($g/m^2$) | WAVING | WRINKLING |
|---|---|---|---|---|---|
| PAPER I | 30% | R1 | 5.0 | Bad | Very Good |
| 〃 | 〃 | R2 | 3.0 | Good | Very Good |
| 〃 | 〃 | R3 | 1.5 | Very Good | Very Good |
| 〃 | 〃 | R4 | 1.0 | Very Good | Good |
| 〃 | 〃 | R5 | 0.6 | Very Good | Bad |
| 〃 | 〃 | R6 | 0.5 | Very Good | Bad |
| PAPER II | 40% | R1 | 5.2 | Bad | Very Good |
| 〃 | 〃 | R2 | 3.0 | Good | Very Good |
| 〃 | 〃 | R3 | 1.4 | Very Good | Very Good |
| 〃 | 〃 | R4 | 1.0 | Very Good | Good |
| 〃 | 〃 | R5 | 0.6 | Very Good | Bad |
| 〃 | 〃 | R6 | 0.4 | Very Good | Bad |
| PAPER III | 80% | R1 | 5.2 | Very Good | Very Good |
| 〃 | 〃 | R2 | 2.9 | Very Good | Very Good |
| 〃 | 〃 | R3 | 1.4 | Very Good | Very Good |
| 〃 | 〃 | R4 | 0.9 | Very Good | Very Good |
| 〃 | 〃 | R5 | 0.5 | Very Good | Very Good |
| 〃 | 〃 | R6 | 0.3 | Very Good | Very Good |

INK JET RECORDING APPARATUS AND INK JET RECORDING METHOD

CROSS REFERENCE TO RELATED APPLICATIONS

This application is a Continuation of PCT International Application No. PCT/JP2015/062351 filed on Apr. 23, 2015, which claims priority under 35 U.S.C. §119(a) to Patent Application No. 2014-176729 filed in Japan on Sep. 1, 2014, all of which are hereby expressly incorporated by reference into the present application.

BACKGROUND OF THE INVENTION

1. Field of the Invention

The present invention relates to an ink jet recording apparatus and an ink jet recording method and, in particular, to a drying technique which prevents the occurrence of waving and wrinkling of paper after recording.

2. Description of the Related Art

A method of drying paper on which an image is formed while transporting the paper using a chain gripper is known (JP2011-173337A). In this method, even stiff thick paper can be stably transported without contact with a drying unit caused by jumping or the like. In addition, in a case where a flat transport guide is used as the chain gripper, the transport guide can be fixed without necessarily being driven. Therefore, a cooling device such as a water cooling device can be easily mounted on the transport guide, and thus a heater having a large heat capacity can be mounted as a drying unit. Therefore, this method is advantageous in drying paper within a short period of time without damages.

However, in a case where an image is formed on thin paper using an aqueous ink, water in the ink permeates into the paper, which causes elongation in the paper. Therefore, three-dimensional waving occurs in the paper, and thus the printing quality deteriorates.

On the other hand, by suctioning paper to a transport guide and drying the paper while maintaining the paper in a flat shape, the occurrence of waving in the paper can be reduced. JP2014-073658A describes a technique in which a back tension applying mechanism includes a guide plate and a suction mechanism that sucks air through suction holes formed on the guide plate, the back tension applying mechanism applying back tension to paper P which is transported while a leading end of the paper P is gripped by a chain gripper.

SUMMARY OF THE INVENTION

However, when paper is dried while being transported, in a case where the suctioned paper is sufficiently dried, there is a problem in that fine wrinkles may remain in the paper.

The present invention has been made in consideration of the above-described circumstances, and an object thereof is to provide an ink jet recording apparatus and an ink jet recording method, in which the occurrence of waving and wrinkling in paper is prevented when the paper is dried while being transported.

According to an aspect of the invention for achieving the above-described object, there is provided an ink jet recording apparatus comprising: an image recording portion that forms an image on a recording surface of a sheet of paper by an ink jet method using an aqueous ink including a water in solvent; and an ink drying portion that dries the paper while transporting the paper having the recording surface on which the image is formed, wherein the ink drying portion includes, a transport unit that grips a leading end of the paper and transports the paper along a transport path, a heating unit that is provided along the transport path and heats the recording surface of the paper which is transported, an guide unit that is provided along the transport path and supports the paper, which is transported, from a surface of the paper opposite to the recording surface using a guide surface having suction holes, and a suction unit that suctions the paper through the suction holes of the guide surface, and wherein the ink drying portion transporting the paper by setting upstream of a first position of the transport path as a suction region in which the paper is suctioned by the suction unit, and downstream of the first position as a non-suction region, and the first position is set at a position in which a residual water content in the paper is 1.0 $g/m^2$ to 3.0 $g/m^2$.

According to this aspect, when a sheet of paper having a recording surface, on which an image is formed by an ink jet method using an aqueous ink including water as a major component of a solvent, is dried while being transported, the suction region in which the paper is suctioned by the suction unit is set upstream of a first position of the transport path, the non-suction region is set downstream of the first position, and the first position is set at a position in which a residual water content in the paper is 1.0 $g/m^2$ to 3.0 $g/m^2$. Therefore, when the paper is dried while being transported, the occurrence of waving and wrinkling in the paper can be prevented.

Even a case where a region of the paper P provided downstream of the first position is suctioned to a small degree that wrinkling does not occur is included in "the non-suction region" according to the aspect.

It is preferable that the ink drying portion dries the paper until the residual water content in the paper is 0.7 $g/m^2$ or lower. As a result, the paper can be appropriately dried.

It is preferable that the ink drying portion adjusts a heating amount of the heating unit according to the weight of the paper per unit area. As a result, the paper can be appropriately dried.

It is preferable that the guide unit includes temperature control unit that controls a temperature of the guide surface. As a result, overheating or dew condensation of the guide surface can be prevented.

It is preferable that the transport unit is a chain gripper. As a result, the paper can be appropriately transported.

It is preferable that the heating unit includes an infrared heater and a warm air unit. As a result, the paper can be appropriately heated.

According to another aspect of the present invention for achieving the above-described object, there is provided an ink jet recording method comprising: an image recording step of forming an image on a recording surface of a sheet of paper by an ink jet method using an aqueous ink including a solvent and water; and an ink drying step of drying the paper having the recording surface on which the image is formed while transporting the paper, wherein the ink drying step includes a transporting step of gripping a leading end of the paper and transporting the paper along a transport path, a heating step of heating the recording surface of the paper which is transported, a guide step of supporting the paper, which is transported, from a surface of the paper opposite to the recording surface using a guide surface having suction holes, and a suction step of suctioning the paper through the suction holes of the guide surface, in the ink drying step, the paper is transported by setting upstream of a first position of the transport path as a suction region in which the paper is suctioned in the suction step and downstream of the first position as a non-suction region, and the first position is set at a position in which a residual water content in the paper is 1.0 g/m$^2$ to 3.0 g/m$^2$.

According to this aspect, when a sheet of paper having a recording surface, on which an image is formed by an ink jet method using an aqueous ink including water as a major component of a solvent, is dried while being transported, the suction region in which the paper is suctioned by the suction unit is set upstream of a first position of the transport path, the non-suction region is set downstream of the first position, and the first position is set at a position in which a residual water content in the paper is 1.0 g/m$^2$ to 3.0 g/m$^2$. Therefore, when the paper is dried while being transported, the occurrence of waving and wrinkling in the paper can be prevented.

It is preferable that, in the ink drying step, the paper is dried until the residual water content in the paper is 0.7 g/m$^2$ or lower. As a result, the paper can be appropriately dried.

It is preferable that, in the ink drying step, a heating amount of the heating unit is adjusted according to the weight of the paper per unit area. As a result, the paper can be appropriately dried.

According to the present invention, the occurrence of waving and wrinkling in paper can be prevented.

BRIEF DESCRIPTION OF THE DRAWINGS

FIG. 8 is a diagram showing the results of evaluating wrinkling and waving occurring when paper is dried.

DESCRIPTION OF THE PREFERRED EMBODIMENTS

Hereinafter, a preferable embodiment of the present invention will be described in detail with reference to the accompanying drawings.

<Overall Configuration of Ink Jet Recording Apparatus>

First, an overall configuration of an ink jet recording apparatus according to the embodiment will be described. An ink jet recording apparatus 10 forms a color image on a sheet of paper by jetting aqueous inks of four colors including cyan (C), magenta (M), yellow (Y), and black (K) to the sheet of paper. The aqueous ink is an ink including water as a major component of a solvent, in which a colorant such as a dye or a pigment is dissolved or dispersed in water and a water-soluble solvent.

Figure 1:
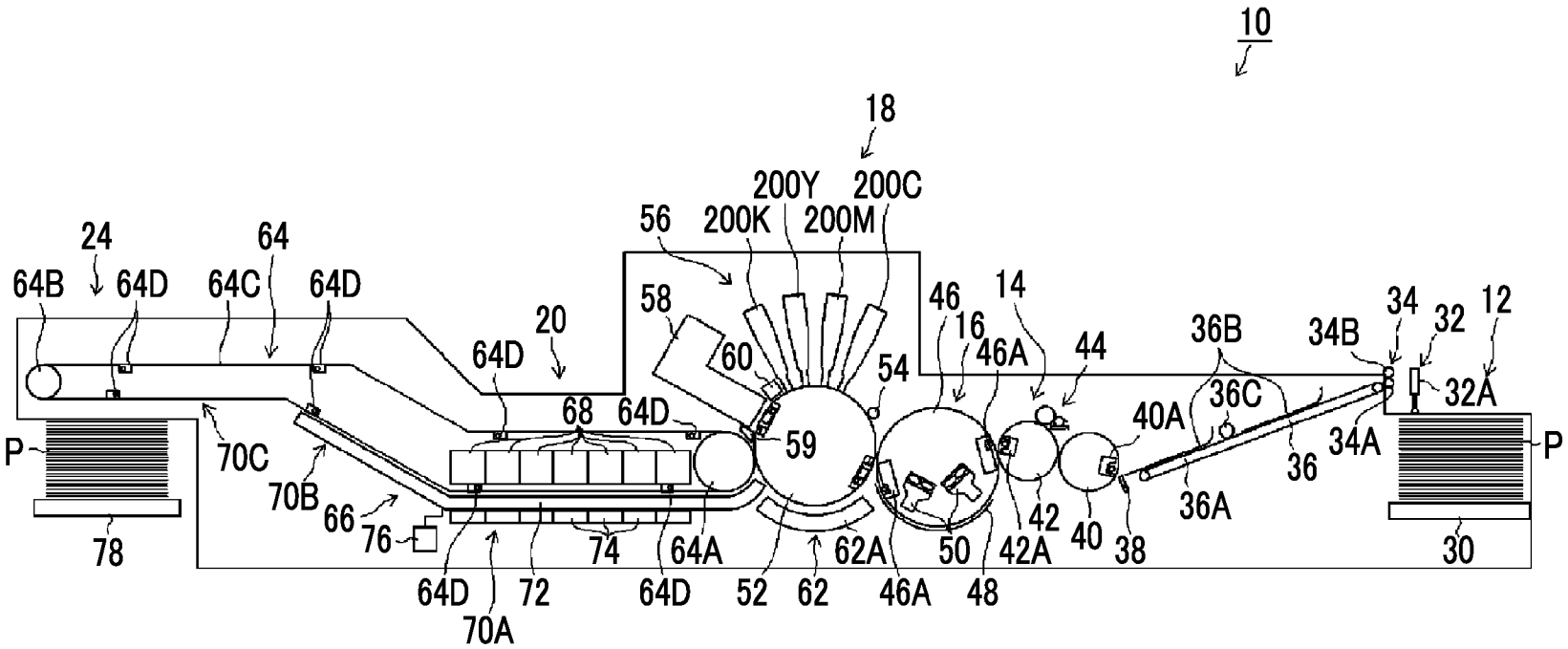
FIG. 1 is a diagram schematically showing an overall configuration of an ink jet recording apparatus.

As shown in FIG. 1, roughly, the ink jet recording apparatus 10 includes: a paper feed portion 12 that feeds paper P which is a sheet type recording medium; a treatment liquid applying portion 14 that applies a treatment liquid to a surface (recording surface) of the paper P fed from the paper feed portion 12; a treatment liquid drying portion 16 that dries the paper P to which the treatment liquid is applied; an image recording portion 18 that forms a color image on the surface of the dried paper P by jetting ink droplets thereto using an ink jet method; an ink drying portion 20 that dries the paper P on which the image is formed; and a paper discharge portion 24 that discharges and collects the dried paper P.

[Paper Feed Portion]

The paper feed portion 12 feeds sheets of paper P, which are stacked on a paper feed tray 30, to the treatment liquid applying portion 14 one by one. Roughly, the paper feed portion 12 includes a paper feed tray 30, a sucker device 32, a paper feed roller pair 34, a feeder board 36, a front abutment 38, and a paper feed drum 40.

The paper P is stacked on the paper feed tray 30 in the form of a stack in which plural sheets are stacked. The paper feed tray 30 is provided so as to be liftable by a paper feed tray elevator (not shown). The paper feed tray elevator is controlled to be driven in conjunction with an increase or a decrease in the number of sheets of paper P stacked on the paper feed tray 30, and lifts the paper feed tray 30 up and down such that a sheet of paper P stacked on the top of a stack is positioned at a fixed height.

The sucker device 32 picks up sheets of paper P stacked on the paper feed tray 30 from the top one by one and feeds the paper P to the paper feed roller pair 34. The sucker device 32 includes a suction foot 32A which is provided liftably and swingably. The suction foot 32A sucks and holds a top surface of the paper P and transports the paper P from the paper feed tray 30 to the paper feed roller pair 34. At this time, the suction foot 32A picks up the sheet of paper P stacked on the top of the stack by sucking and holding a top surface of the paper on a leading end side, and inserts the leading end of the picked paper P between a pair of rollers 34A and 34B constituting the paper feed roller pair 34.

The paper feed roller pair 34 includes the pair of upper and lower rollers 34A and 34B which are pressed into contact with each other. Among the pair of upper and lower rollers 34A and 34B, one is a driving roller (roller 34A), and the other is a driven roller (roller 34B). The driving roller (roller 34A) is driven to rotate by a motor (not shown). The motor is drive in conjunction with the feeding of the paper P. Once the paper P is fed from the sucker device 32, the driving roller (roller 34A) is rotated at this time. The paper P inserted between the pair of upper and lower rollers 34A and 34B is nipped between the rollers 34A and 34B and is transported in a rotating direction of the rollers 34A and 34B (an installation direction of the feeder board 36).

The feeder board 36 is formed so as to correspond to the paper width and guides the paper P, which is transported from the paper feed roller pair 34, to the front abutment 38. This feeder board 36 is provided to be inclined such that a leading end side thereof faces downward, and guides the paper P, which is loaded on a transport surface of the feeder boarder 36, to the front abutment 38 by sliding the paper P along the transport surface.

In the feeder board 36, plural tape feeders 36A for transporting the paper P are provided at intervals in a width direction. The tape feeders 36A are formed in an endless shape and are drive to rotate by a motor (not shown). The paper P loaded on the transport surface of the feeder board 36 is transported onto the feeder board 36 by the tape feeders 36A.

In addition, retainers 36B and a roller 36C are provided above the feeder board 36.

The plural retainers 36B (in this example, two) are provided in tandem in a front-rear direction along the transport surface of the paper P. The retainers 36B are formed using a plate spring having a width corresponding to the paper width and are provided to be pressed into contact with the transport surface. The paper P which is transported onto the feeder board 36 by the tape feeders 36A passes through the retainers 36B such that unevenness thereof is corrected. In order to easily introduce the paper P between the retainers 36B and the feeder board 36, the retainers 36B are formed such that rear end portions thereof are curled.

The roller 36C is provided between the front and back retainers 36B. This roller 36C is provided so as to be pressed into contact with the transport surface of the paper P. The paper P transported between the front and rear retainers 36B is transported while the top surface thereof is pressed by the roller 36C.

The front abutment 38 corrects the posture of the paper P. The front abutment 38 is formed in a plate shape and is provided perpendicular to a transport direction of the paper P. In addition, the front abutment 38 is driven to be swingable by a motor (not shown). The posture of the paper P transported along the feeder board 36 is corrected (so called skew prevention) by the leading end thereof being pressed against the front abutment 38. The front abutment 38 swings in conjunction with the feeding of the paper to the paper feed drum 40 and delivers the paper P whose posture is corrected to the paper feed drum 40.

The paper feed drum 40 receives the paper P, which is fed from the feeder board 36 through the front abutment 38, and transports the paper P to the treatment liquid applying portion 14. The paper feed drum 40 is formed in a cylindrical shape and is driven to rotate by a motor (not shown). A gripper 40A is provided on an outer circumferential surface of the paper feed drum 40, and the leading end of the paper P is gripped by the gripper 40A. The paper feed drum 40 rotates while gripping the leading end of the paper P using the gripper 40A so as transport the paper P to the treatment liquid applying portion 14 while winding the paper P around the circumferential surface.

The paper feed portion 12 is configured as described above. The sheets of paper P stacked on the paper feed tray 30 are picked up from the top one by one by the sucker device 32 and are fed to the paper feed roller pair 34. The paper P fed to the paper feed roller pair 34 is transported forward by the pair of upper and lower rollers 34A and 34B constituting the paper feed roller pair 34 and is loaded on the feeder board 36. The paper P loaded on the feeder board 36 is transported by the tape feeder 36A provided on the transport surface of the feeder board 36. During the transport process, the paper P is pressed against the transport surface of the feeder board 36 by the retainers 36B such that unevenness of the paper P is corrected. The leading end of the paper P transported by the feeder board 36 is pressed against the front abutment 38 such that the inclination thereof is corrected, and then is delivered to the paper feed drum 40. The paper P is transported to the treatment liquid applying portion 14 by the paper feed drum 40.

[Treatment Liquid Applying Portion]

The treatment liquid applying portion 14 applies a treatment liquid, which has a function of aggregating the ink, to the surface (recording surface) of the paper P. Roughly, the treatment liquid applying portion 14 includes: a treatment liquid applying drum 42 that transports the paper P; and a treatment liquid applying device 44 that applies the treatment liquid to the surface (recording surface) of the paper P transported by the treatment liquid applying drum 42.

The treatment liquid applying drum 42 functions as holding unit (recording medium holding unit) for holding the paper P which is the recording medium and also functions as transport unit that transports the paper P which is the recording medium. The treatment liquid applying drum 42 receives the paper P from the paper feed drum 40 of the paper feed portion 12 and rotates while holding the paper P on the outer circumferential surface such that the paper P is transported to the treatment liquid drying portion 16.

The treatment liquid applying drum 42 is formed in a cylindrical shape and is driven to rotate by a motor (not shown). A gripper 42A is provided on an outer circumferential surface of the treatment liquid applying drum 42, and the leading end of the paper P is gripped by the gripper 42A. The treatment liquid applying drum 42 rotates while gripping the leading end of the paper P using the gripper 42A so as transport the paper P to the treatment liquid drying portion 16 while winding the paper P around the circumferential surface (a sheet of paper P is transported per one rotation). The rotations of the treatment liquid applying drum 42 and the paper feed drum 40 are controlled such that the reception timing of the paper P matches with the delivery timing of the paper P. That is, the treatment liquid applying drum 42 and the paper feed drum 40 are driven at the same circumferential speed such that the positions of the grippers match with each other.

The treatment liquid applying device 44 functions as treatment liquid applying unit that applies the treatment liquid to the surface of the paper P transported by the treatment liquid applying drum 42. The treatment liquid applying device 44 is configured as, for example, a roller applying device in which an applying roller having a circumferential surface to which the treatment liquid is applied is pressed into contact with the surface of the paper P such that the treatment liquid is applied to the surface of the paper P. In addition, the treatment liquid applying device 44 may be configured, for example, as a head of jetting the treatment liquid using an ink jet method to be applied to the surface of the paper P or as a spray of spraying the treatment liquid to be applied to the surface of the paper P.

The treatment liquid applying portion 14 is configured as described above. The paper P delivered from the paper feed drum 40 of the paper feed portion 12 is received by the treatment liquid applying drum 42. The treatment liquid applying drum 42 rotates while gripping the leading end of the paper P using the gripper 42A so as transport the paper P while winding the paper P around the circumferential surface. During the transport process, the applying roller is pressed against the surface of the paper P such that the applying roller rolls on the paper and the treatment liquid is applied to the surface of the paper P.

The treatment liquid applied by the treatment liquid applying portion 14 is formed of a liquid including an aggregating agent which causes components in the ink composition to aggregate. The aggregating agent may be a compound which can change the pH of the ink composition, a polyvalent metal salt, or a polyallylamine Preferable examples of the compound which can reduce the pH include a highly water-soluble acidic material (for example, phosphoric acid, oxalic acid, malonic acid, citric acid, or a derivative or a salt thereof). Among these acidic materials, one kind may be used alone, or two or more kinds may be used in combination. As a result, the aggregating properties can be improved, and the entire ink can be fixed. In addition, it is preferable that the pH (25° C.) of the ink composition is 8.0 or higher and the pH (25° C.) of the treatment liquid is in a range of 0.5 to 4. As a result, the improvement of the image density, the resolution, and high-speed ink jet recording can be realized.

The treatment liquid may include additives, and examples thereof include well-known additives such as an anti-drying agent (wetting agent), an anti-fading agent, an emulsion stabilizer, a penetration enhancer, a ultraviolet absorber, a preservative, a fungicide, a pH adjuster, a surface tension adjuster, an anti-foaming agent, a viscosity adjuster, a dispersant, a dispersion stabilizer, a rust inhibitor, or a chelating agent, This treatment liquid is applied to the surface (recording surface) of the paper P to form an image. As a result, defects such as feathering or bleeding can be prevented, and even in a case where a common printing paper having permeability is used, high-quality printing can be performed.

(Treatment Liquid Drying Portion)

The treatment liquid drying portion 16 dries the paper P having the surface to which the treatment liquid is applied. Roughly, the treatment liquid drying portion 16 includes: a treatment liquid drying drum 46 that transports the paper P; a paper transport guide 48; and a treatment liquid drying unit 50 that blows warm air to the recording surface of the paper P, which is transported by the treatment liquid drying drum 46, to dry the paper P.

The treatment liquid drying drum 46 receives the paper from the treatment liquid applying drum 42 of the treatment liquid applying portion 14 and transports the paper P to the image recording portion 18. The treatment liquid drying drum 46 is configured as a frame body having a cylindrical shape and is driven to rotate by a motor (not shown). A gripper 46A is provided on an outer circumferential surface of the treatment liquid drying drum 46, and the leading end of the paper P is gripped by the gripper 46A. The treatment liquid drying drum 46 rotates while gripping the leading end of the paper P using the gripper 46A so as transport the paper P to the image recording portion 18. In the treatment liquid drying drum 46 of this example, the gripper 46A is provided at two positions on the outer circumferential surface such that two sheets of paper P can be transported per one rotation. The rotations of the treatment liquid drying drum 46 and the treatment liquid applying drum 42 are controlled such that the reception timing of the paper P matches with the delivery timing of the paper P. That is, the treatment liquid drying drum 46 and the treatment liquid applying drum 42 are driven at the same circumferential speed such that the positions of the grippers match with each other.

The paper transport guide 48 is provided along the transport path of the paper P transported by the treatment liquid drying drum 46, and guides the transport of the paper P.

The treatment liquid drying unit 50 is provided inside the treatment liquid drying drum 46 and blows warm air to the surface of the paper P, which is transported by the treatment liquid drying drum 46, to dry the paper P. In this example, two treatment liquid drying units 50 are provided inside the treatment liquid drying drum 46 and blows warm air to the surface of the paper P, which is transported by the treatment liquid drying drum 46, to dry the paper P.

The treatment liquid drying portion 16 is configured as described above. The paper P delivered from the treatment liquid applying drum 42 of the treatment liquid applying portion 14 is received by the treatment liquid drying drum 46. The treatment liquid drying drum 46 rotates while gripping the leading end of the paper P using the gripper 46A so as transport the paper P. At this time, the treatment liquid drying drum 46 transports the paper P such that the surface of the paper P (the surface to which the treatment liquid is applied) faces inward. While transported by the treatment liquid drying drum 46, the paper P is dried by the treatment liquid drying unit 50, which is provided inside the treatment liquid drying drum 46, blowing warm air to the surface of the paper P. That is, the solvent component is removed from the treatment liquid. As a result, an ink aggregation layer is formed on the surface of the paper P.

[Image Recording Portion]

The image recording portion 18 jets inks of various colors including C, M, Y, and K to the recording surface of the paper P to form a color image on the recording surface of the paper P (an example of the image recording step). Roughly, the image recording portion 18 includes: an image recording drum 52 that transports the paper P; a paper pressing roller 54 that presses transported by the image recording drum 52 such that the paper adheres to the circumferential surface of the image recording drum 52; a head unit 56 that jets ink droplets of various colors including C, M, Y, and K to the paper P to form an image on the paper P; an in-line sensor 58 that functions as image reading unit that reads the image formed on the paper P; a mist filter 60 that traps ink mist; and a drum cooling unit 62 that cools the image recording drum 52.

The image recording drum 52 functions as recording medium holding unit that holds the paper P which is the recording medium and also functions as transport unit that transports the paper P which is the recording medium. The image recording drum 52 receives the paper P from the treatment liquid drying drum 46 of the treatment liquid drying portion 16 and delivers the paper P to the ink drying portion 20. The image recording drum 52 is formed in a cylindrical shape and is driven to rotate by a motor (not shown). A gripper is provided on an outer circumferential surface of the image recording drum 52, and the leading end of the paper P is gripped by the gripper. The image recording drum 52 rotates while gripping the leading end of the paper P using the gripper so as transport the paper P to the ink drying portion 20 while winding the paper P around the circumferential surface. In addition, on the circumferential surface of the image recording drum 52, plural suction holes (not shown) are formed in a predetermined pattern. The paper P wound around the circumferential surface of the image recording drum 52 is suctioned through the suction holes such that the paper P is transported while being suctioned and held on the circumferential surface of the image recording drum 52. As a result, the paper P can be transported with high flatness.

The paper pressing roller 54 is provided near a paper reception position of the image recording drum 52 (a position where the paper P is received from the treatment liquid drying drum 46). This paper pressing roller 54 is configured as a rubber roller and is provided so as to be pressed into contact with the circumferential surface of the image recording drum 52. The paper P delivered from the treatment liquid drying drum 46 to the image recording drum 52 is nipped by passing through the paper pressing roller 54 so as to adhere to the circumferential surface of the image recording drum 52.

The head unit 56 includes: an ink jet head 200C that jets ink droplets of cyan (C) using an ink jet method; an ink jet head 200M that jets ink droplets of magenta (M) using an ink jet method; an ink jet head 200Y that jets ink droplets of yellow (Y) using an ink jet method; and an ink jet head 200K that jets ink droplets of black (K) using an ink jet method. The respective ink jet heads 200C, 200M, 200Y, and 200K are provided at regular intervals along the transport path of the paper P transported by the image recording drum 52.

Each of the ink jet heads 200C, 200M, 200Y, and 200K is configured as a line head and is formed with a length corresponding to the maximum paper width. Each of the ink jet heads 200C, 200M, 200Y, and 200K is disposed such that a nozzle surface thereof (a surface where nozzles are disposed) faces the circumferential surface of the image recording drum 52.

Each of the ink jet heads 200C, 200M, 200Y, and 200K jets ink droplets to the image recording drum 52 from nozzles formed on the nozzle surface to form an image on the paper P transported by the image recording drum 52.

The configuration of the ink jet heads 200C, 200M, 200Y, and 200K will be described below in detail.

The in-line sensor 58 functions as image reading unit that reads the image formed on the paper P. The in-line sensor 58 is provided downstream of the ink jet head 200K positioned at the end of line in the transport direction of the paper P transported by the image recording drum 52, and reads the image formed by the ink jet heads 200C, 200M, 200Y, and 200K. This in-line sensor 58 is configured as, for example, a line scanner and reads the image, which is formed by the ink jet heads 200C, 200M, 200Y, and 200K, from the paper P transported by the image recording drum 52.

On the downstream side of the in-line sensor 58, a contact preventing plate 59 is provided near the in-line sensor 58. In a case where the paper P floats due to defects or the like during the transport, this contact preventing plate 59 prevents contact between the paper P and the in-line sensor 58.

The mist filter 60 is provided between the ink jet head 200K at the end of line and the in-line sensor 58 and suctions air near the image recording drum 52 to trap ink mist. In this way, by suctioning air near the image recording drum 52 to trap ink mist, the permeation of ink mist to the in-line sensor 58 can be prevented, and the occurrence of reading failure and the like can be prevented.

The drum cooling unit 62 blows cold air to the image recording drum 52 to cool the drum cooling unit 52. Roughly, this drum cooling unit 62 includes: an air conditioner (not shown); and a duct 62A that blows cold air supplied from the air conditioner to the circumferential surface of the image recording drum 52. The duct 62A blows cold air a region of the image recording drum 52 other than the transport region of the paper P to cool the image recording drum 52. In this example, the paper P is transported along a substantially upper half arc-shaped surface of the image recording drum 52. Therefore, the duct 62A is configured to blow cold air to a substantially lower half region of the image recording drum 52 to cool the image recording drum 52. Specifically, the duct 62A is formed in an arc shape such that an outlet of the duct 62A covers the substantially lower half region of the image recording drum 52 and is configured to blow cold air to the substantially lower half region of the image recording drum 52.

Here, a temperature at which the image recording drum 52 is cooled is determined based on a relationship with a temperature of each of the ink jet head 200C, 200M, 200Y, and 200K (in particular, a temperature of the nozzle surface) and is set to be lower than the temperature of each of the ink jet heads 200C, 200M, 200Y, and 200K. As a result, the occurrence of dew condensation can be prevented in the ink jet heads 200C, 200M, 200Y, and 200K. That is, by setting the temperature of the image recording drum 52 to be lower than the temperature of each of the ink jet heads 200C, 200M, 200Y, and 200K, dew condensation can be induced on the image recording drum side, and the occurrence of dew condensation (in particular, the occurrence of dew condensation in the nozzle surface) can be prevented in the ink jet heads 200C, 200M, 200Y, and 200K.

The image recording portion 18 is configured as described above. The paper P delivered from the treatment liquid drying drum 46 of the treatment liquid drying portion 16 is received by the image recording drum 52. The image recording drum 52 rotates while gripping the leading end of the paper P using the gripper so as transport the paper P. The paper P delivered to the image recording drum 52 passes through the paper pressing roller 54 so as to adhere to the circumferential surface of the image recording drum 52. Concurrently, the paper P is suctioned through the suction holes of the image recording drum 52 and is adhered and held on the outer circumferential surface of the image recording drum 52. The paper P is transported in this state and passes through the ink jet heads 200C, 200M, 200Y, and 200K. During the passage, ink droplets of the respective colors including C, M, Y, and K are jetted from the respective ink jet heads 200C, 200M, 200Y, and 200K to draw a color image on the surface. Since the ink aggregation layer is formed on the surface of the paper P, a high-quality image can be formed without the occurrence of feathering, bleeding, or the like.

The paper P on which the image is formed by the ink jet heads 200C, 200M, 200Y, and 200K passes through the in-line sensor 58. During the passage of the in-line sensor 58, the image formed on the surface is read. The reading of the formed image is optionally performed, and the scanning of jetting failure and the like is performed on the read image. During the reading, the image is read while being adhered and held by the image recording drum 52. Therefore, the image can be read with high accuracy. In addition, the image is read immediately after formed. Therefore, defects such as jetting failure can be immediately detected and can be dealt with rapidly. As a result, unnecessary recording can be prevented, and the generation of waste paper can be minimized.

Next, after the adherence is released, the paper P is delivered to the ink drying portion 20.

[Ink Drying Portion]

The ink drying portion 20 dries the paper P on which the image is formed, and a liquid component (water) remaining in the surface of the paper P is removed. The ink drying portion 20 includes: a chain gripper 64 that transports the paper P on which the image is formed; a back tension applying mechanism 66 that applies back tension to the paper P transported by the chain gripper 64; and an ink drying unit 68 that dries the paper P transported by the chain gripper 64.

The chain gripper 64 is paper transport unit which is used in common by the ink drying portion 20 and the paper discharge portion 24, and receives the paper P from the image recording portion 18 and transports the paper P to the paper discharge portion 24 (an example of the transporting step).

Roughly, the chain gripper 64 includes: a first sprocket 64A that is provided adjacent to the image recording drum 52; a second sprocket 64B that is provided in the paper discharge portion 24; an endless chain 64C that is wound around the first sprocket 64A and the second sprocket 64B; plural chain guides (not shown) that guides the traveling of the chain 64C; and plural grippers 64D that are attached to the chain 64C at regular intervals. The first sprocket 64A, the second sprocket 64B, the chain 64C, and the chain guide are provided in pairs, and the pairs of them are disposed on opposite sides in the width direction of the paper P, respectively. The grippers 64D are provided to be stretched between the pair of chains 64C.

The first sprocket 64A are provided adjacent to the image recording drum 52 such that the paper P delivered from the image recording drum 52 can be received by the grippers 64D. The first sprockets 64A are axially supported by bearings (not shown), are rotatably provided, and are linked to a motor (not shown). The chains 64C wound around the first sprockets 64A and the second sprockets 64B are driven to travel by the motor.

The second sprockets 64B are provided in the paper discharge portion 24 such that the paper P received from the image recording drum 52 can be collected by the paper discharge portion 24. That is, installation positions of the second sprockets 64B are terminals of the transport path of the paper P transported by the chain grippers 64. The second sprockets 64B are axially supported by bearings (not shown) and are rotatably provided.

The chains 64C are formed in an endless shape and are wound around the first sprockets 64A and the second sprockets 64B.

The chain guides are disposed at predetermined positions and guide the chains 64C such that the chains 64C travel along predetermined paths. That is, the chain guides guide the chains 64C such that the paper P travels and is transported along a predetermined transport path. In the ink jet recording apparatus 10 of this example, the second sprockets 64B are provided at higher positions than the first sprocket 64A. Therefore, a traveling path is formed such that the chains 64C are inclined midway. Specifically, the traveling path includes a first horizontal transport path 70A, an inclined transport path 70B, and a second horizontal transport path 70C.

The first horizontal transport path 70A is set at the same height as that of the first sprockets 64A such that the chains 64C wound around the first sprockets 64A travel horizontally.

The second horizontal transport path 70C is set at the same height as that of the second sprockets 64B such that the chains 64C wound around the second sprockets 64B travel horizontally.

The inclined transport path 70B is set between the first horizontal transport path 70A and the second horizontal transport path 70C so as to bridge between the first horizontal transport path 70A and the second horizontal transport path 70C.

The chain guides are provided so as to form the first horizontal transport path 70A, the inclined transport path 70B, and the second horizontal transport path 70C. Specifically, the chain guides are provided at least a joining point between the first horizontal transport path 70A and the inclined transport path 70B and a joining point between the inclined transport path 70B and the second horizontal transport path 70C.

Plural grippers 64D are attached to the chains 64C at regular intervals. The attachment intervals of the grippers 64D are set to correspond to intervals at which the paper P is received from the image recording drum 52. That is, in order to receive the paper P, which is successively delivered from the image recording drum 52, at an appropriate timing, the attachment intervals of the grippers 64D are set to correspond to intervals at which the paper P is received from the image recording drum 52.

The chain grippers 64 are configured as described above. Once the motor (not shown) connected to the first sprockets 64A as described above is driven, the chains 64C travel. The chains 64C travel at the same circumferential speed as that of the image recording drum 52. In addition, the timing is set such that the paper P delivered from the image recording drum 52 can be received by the grippers 64D.

The back tension applying mechanism 66 applies back tension to the paper P which is transported while the leading end thereof is held by the chain grippers 64. Roughly, the back tension applying mechanism 66 includes: a guide plate 72; and a suction mechanism 74 that sucks air through suction holes (not shown) formed on the guide plate 72.

The guide plate 72 is configured as a hollow box plate having a width corresponding to the paper width. The guide plate 72 is provided along the transport path of the paper P transported by the chain grippers 64 (that is, the traveling path of the chains). Specifically, the guide plate 72 is provided along the chains 64C traveling the first horizontal transport path 70A and the inclined transport path 70B and is at a predetermined distance from the chains 64C. The guide plate 72 (an example of the guide unit) supports the paper P, which is transported by the chain grippers 64, from a surface of the paper P opposite to the recording surface using a guide surface thereof (surface opposite to the chains 64C). That is, the back surface (the surface opposite to the recording surface) of the paper P transported by the chain grippers 64 is supported by the guide surface of the guide plate 72 and is transported while sliding on the guide surface.

On the guide surface (top surface) of the guide plate 72, plural suction holes (not shown) are formed in a predetermined pattern. As described above, the guide plate 72 is formed of a hollow box plate. The suction mechanism 74 (an example of the suction unit) suctions the hollow portion (inside) of the guide plate 72. As a result, air is sucked through the suction holes formed on the guide surface.

By suctioning air through the suction holes of the guide plate 72, the back surface of the paper P transported by the chain grippers 64. As a result, back tension is applied to the paper P transported by the chain grippers 64.

As described above, the guide plate 72 is provided along the chains 64C traveling the first horizontal transport path 70A and the inclined transport path 70B. Therefore, back tension is applied to the paper P while the paper P is transported along the first horizontal transport path 70A and the inclined transport path 70B.

The ink drying unit 68 (an example of the drying unit) is provided inside the chain grippers 64 (in particular, a portion constituting the first horizontal transport path 70A) and dries the paper P transported along the first horizontal transport path 70A. The ink drying unit 68 dries the paper P by irradiating the surface of the paper P, which is transported along the first horizontal transport path 70A, with infrared light and blowing warm air thereto. Plural ink drying units 68 are provided along the first horizontal transport path 70A. The number of ink drying units 68 provided is set based on the processing capacity of the ink drying unit 68, the transport speed (printing speed) of the paper P, or the like. That is, the number of ink drying units 68 provided is set such that the paper P received from the image recording portion 18 is dried while being transported along the first horizontal transport path 70A. Accordingly, the length of the first horizontal transport path 70A is set in consideration of the capacity of the ink drying unit 68.

By performing drying the humidity of the ink drying portion 20 is increased. Once the humidity increases, the drying cannot be performed efficiently. It is preferable that, in the ink drying portion 20, the ink drying unit 68 is provided along with exhaust unit such that humid air generated during the drying can be forcibly exhausted. The exhaust unit can be configured by providing an exhaust duct in the ink drying portion 20 such that air of the ink drying portion 20 is exhausted by the exhaust duct.

In addition, the ink drying portion 20 includes a constant-temperature chiller 76 which circulates warm water at 60° C. to a water-cooled tube (not shown), which is provided on the back surface of the guide plate 72, to maintain (temperature control) the surface temperature of the guide plate 72 at 60° C. This constant-temperature chiller 76 (an example of the temperature control unit) can prevent overheating or dew condensation of the guide plate 72.

The ink drying portion 20 is configured as described above. The paper P delivered from the image recording drum 52 of the image recording portion 18 is received by the chain gripper 64. The chain grippers 64 transport the paper along the planar guide plate 72 while gripping the leading end of the paper P using the grippers 64D. The paper P delivered to the chain grippers 64 is transported along the first horizontal transport path 70A. While being transported along the first horizontal transport path 70A, the paper P is dried by the ink drying unit 68 provided inside the chain grippers 64. That is, the surface (recording surface) is dried by being irradiated with infrared light and being blown with warm air At this time, the paper P is dried while receiving back tension applied by the back tension applying mechanism 66. As a result, the paper P can be dried while preventing deformation of the paper P.

[Paper Discharge Portion]

The paper discharge portion 24 discharges and collects the paper P having undergone a series of image recording processes. Roughly, the paper discharge portion 24 includes: the chain grippers 64 that transport the paper P; and a paper discharge tray 78 on which the paper P is stacked and collected. The chain grippers 64 release the paper P on the paper discharge tray 78 to stack the paper P on the paper discharge tray 78.

The paper P released from the chain grippers 64 is stacked and collected on the paper discharge tray 78. The paper discharge tray 78 includes paper abutments (not shown; for example, a front paper abutment, a rear paper abutment, or a horizontal paper abutment) so that the paper P is stacked neatly.

In addition, the paper discharge tray 78 is provided so as to be liftable by a paper discharge tray elevator (not shown). The paper discharge tray elevator is controlled to be driven in conjunction with an increase or a decrease in the number of sheets of paper P stacked on the paper discharge tray 78, and lifts the paper discharge tray 78 up and down such that a sheet of paper P stacked on the top of a stack is positioned at a fixed height.

<Configuration of Control System>

Figure 2:
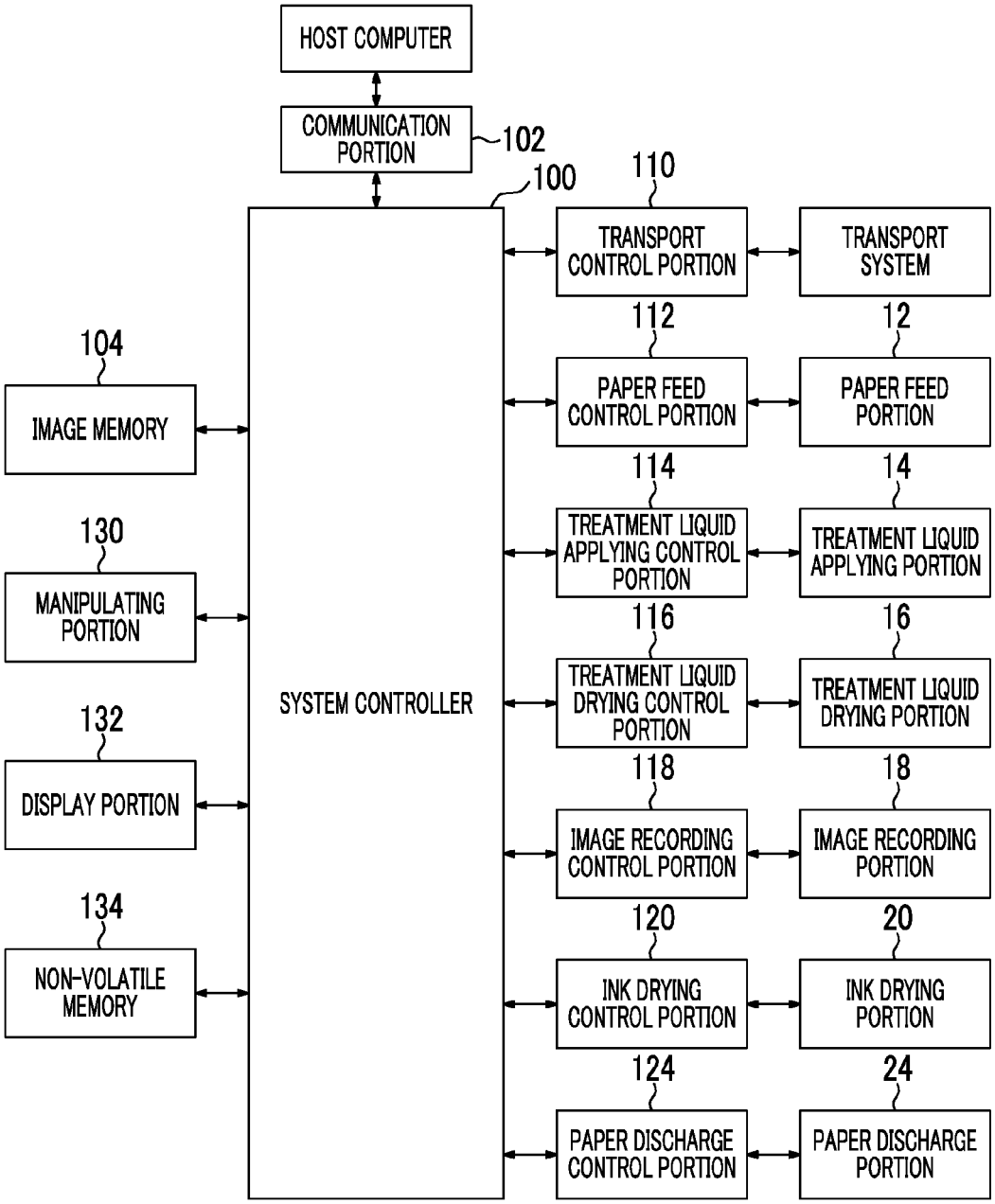
FIG. 2 is a block diagram showing a schematic configuration of a control system of the ink jet recording apparatus.

As shown in FIG. 2, the ink jet recording apparatus 10 includes a system controller 100, a communication portion 102, an image memory 104, a transport control portion 110, a paper feed control portion 112, a treatment liquid applying control portion 114, a treatment liquid drying control portion 116, an image recording control portion 118, an ink drying control portion 120, a paper discharge control portion 124, a manipulating portion 130, a display portion 132, and a non-volatile memory 134.

The system controller 100 functions as control unit for integrally controlling the respective portions of the ink jet recording apparatus 10 and also functions as calculation unit that performs various kinds of arithmetic processing. The system controller 100 operates based on a predetermined control program. In a read only memory (ROM; not shown) of the system controller 100, a control program which is executed by the system controller 100, and various data required for the control are stored.

The communication portion 102 includes a necessary communication interface and exchange data with a host computer connected to the communication interface.

The image memory 104 functions temporary storage that temporarily stores various data including image data and reads and writes data through the system controller 100. Image data input from the host computer through the communication portion 102 is stored in the image memory 104.

The transport control portion 110 controls the transport system of the paper Pin the ink jet recording apparatus 10. That is, the transport control portion 110 controls the driving of the tape feeders 36A, the front abutment 38, and the paper feed drum 40 in the paper feed portion 12 and controls the driving of the treatment liquid applying drum 42 in the treatment liquid applying portion 14, the treatment liquid drying drum 46 in the treatment liquid drying portion 16, and the image recording drum 52 in the image recording portion 18. In addition, the transport control portion 110 controls the driving of the chain grippers 64, which are used in common by the ink drying portion 20 and the paper discharge portion 24, and the back tension applying mechanism 66. Further, the transport control portion 110 controls the suction mechanism 74 and determines suction stop positions described below.

The transport control portion 110 controls the transport system based on an instruction given from the system controller 100 such that the paper P is transported smoothly from the paper feed portion 12 to the paper discharge portion 24.

The paper feed control portion 112 controls the paper feed portion 12 based on an instruction given from the system controller 100. Specifically, the paper feed control portion 112 controls the driving of the sucker device 32, the paper feed tray elevating mechanism, and the like such that sheets of papers P stacked on the paper feed tray 30 are fed one by one without overlapping.

The treatment liquid applying control portion 114 controls the treatment liquid applying portion 14 based on an instruction given from the system controller 100. Specifically, the treatment liquid applying control portion 114 controls the driving of the treatment liquid applying device 44 such that the treatment liquid is applied to the paper P transported by the treatment liquid applying drum 42.

The treatment liquid drying control portion 116 controls the treatment liquid drying portion 16 based on an instruction given from the system controller 100. Specifically, the treatment liquid drying control portion 116 controls the driving of the treatment liquid drying unit 50 such that the paper P transported by the treatment liquid drying drum 46 is dried.

The image recording control portion 118 controls the image recording portion 18 based on an instruction given from the system controller 100. Specifically, the image recording control portion 118 controls the driving of the ink jet heads 200C, 200M, 200Y, and 200K such that a predetermined image is formed on the paper P transported by the image recording drum 52. In addition, the image recording control portion 118 controls the operation of the in-line sensor 58 such that the formed image is read.

The ink drying control portion 120 controls the ink drying portion 20 based on an instruction given from the system controller 100. Specifically, the ink drying control portion 120 controls the driving of the ink drying unit 68 such that warm air is blown to the paper P transported by the chain grippers 64.

The paper discharge control portion 124 controls the paper discharge portion 24 based on an instruction given from the system controller 100. Specifically, the paper discharge control portion 124 controls the driving of the paper discharge tray elevating mechanism and the like such that the paper P is stacked on the paper discharge tray 78.

The manipulating portion 130 includes necessary manipulating unit (for example, a manipulation button, a keyboard, or a touch panel) and outputs manipulation information, which is input from the manipulating unit, to the system controller 100. The system controller 100 executes various kinds of processing based on the manipulation information input from the manipulating portion 130.

The display portion 132 includes a display device such as a liquid crystal display (LCD) and displays necessary information on the display device based on an instruction given from the system controller 100.

The non-volatile memory 134 is configured as, for example, an electrically erasable programmable read only memory (EEPROM) and stores various data, various setting information, and the like necessary for the control and the like.

As described above, image data for forming an image on the paper is input from the host computer to the ink jet recording apparatus 10 through the communication portion 102. The input image data is stored in the image memory 104.

The system controller 100 performs necessary signal processing on the image data stored in the image memory 104 to generate dot data. Based on the generated dot data, the system controller 100 controls the driving of the respective ink jet heads 200C, 200M, 200Y, and 200K of the image recording portion 18 such that an image represented by the image data is formed on the paper.

In general, the dot data is generated by performing color conversion processing and halftone processing on the image data. In the color conversion processing, the image data represented by standard Red Green Blue (sRGB) or the like (for example, 8-bit image data represented by Red Green Blue (RGB)) is converted into ink amount data regarding the amounts of various color inks used in the ink jet recording apparatus 10. In this example, the image data is converted into data regarding the ink amount data of various colors including C, M, Y and K. In the halftone processing, the ink amount data of various colors generated by the color conversion processing is converted into dot data of various colors through processing such as error diffusion.

The system controller 100 generates dot data of various colors by performing the color conversion processing and the halftone processing on the image data. Based on the generated dot data of various colors, the system controller 100 controls the driving of the corresponding ink jet heads such that an image represented by the image data is formed on the paper.

In addition, as described below, the system controller 100 performs processing such that an image is formed on the paper P in a predetermined test pattern when positions of head modules constituting the ink jet heads 200C, 200M, 200Y and 200K are determined, the forms image is read by the in-line sensor 58, the read image is processed, and the amount of correction for an attachment position of each head module is calculated.

Although not shown in the drawings, the ink jet recording apparatus 10 includes a maintenance portion that is provided adjacent to the image recording portion 18. The maintenance portion performs maintenance on the ink jet heads 200C, 200M, 200Y, and 200K. The maintenance portion includes, for example, caps that cover the nozzle surfaces of the ink jet heads 200C, 200M, 200Y, and 200K, or a cleaning device that cleans the nozzle surfaces. The head unit 56 is provided so as to be movable between the image recording portion 18 and the maintenance portion by a head unit moving mechanism, and optionally the maintenance thereof is performed by the maintenance portion. For example, in a case where the operation is stopped for a long period of time, the ink jet heads 200C, 200M, 200Y, and 200K move to the maintenance portion such that the nozzle surfaces are covered with the caps. As a result, the drying of the nozzle surfaces is prevented. In addition, as the ink jet heads 200C, 200M, 200Y, and 200K are used, the nozzle surfaces thereof are contaminated. Therefore, the nozzle surfaces are cleaned regularly by the cleaning device. The nozzle surfaces are cleaned, for example, by sweeping the nozzle surfaces with a blade or a web.

<Details of Ink Drying Portion>

Figure 3:
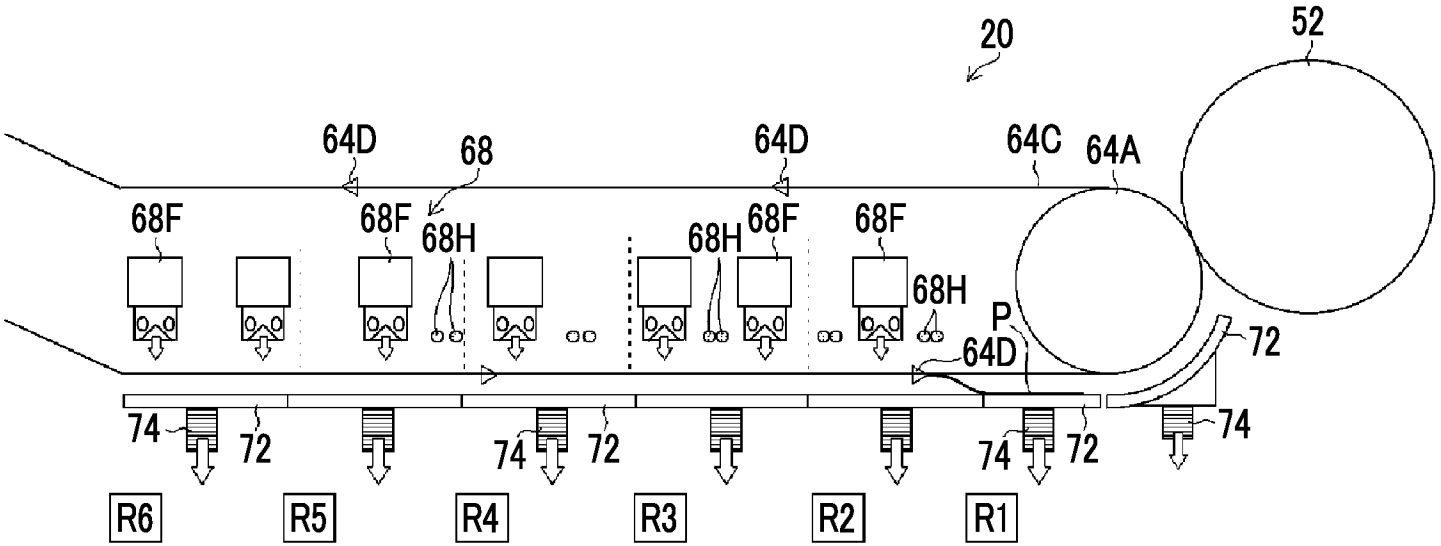
FIG. 3 is an enlarged view showing an ink drying portion.

As shown in FIG. 3, the ink drying unit 68 includes: ten infrared (IR) units 68H (an example of the heating unit) that are provided along the transport direction of the paper P; and seven warm air units 68F (an example of the heating unit). As the IR unit 68H, a carbon heater CRS 4000/1000G (manufactured by Heraeus Holding GmbH; maximum output: 4000 [W]; an example of the infrared heater) is used. The IR unit 68H is configured such that the conduction duty is variable in a range of 0% to 100% and controls the heating amount based on a control signal input from the ink drying control portion 120.

In the warm air unit 68F, the air flow rate is set as 2 [$m^3$/min] and the air temperature is set as 60° C. The warm air unit 68F blows warm air to the guide plate 72.

In addition, on a surface of the guide plate 72 opposite to the ink drying unit 68, seven suction mechanisms 74 are provided along the transport direction of the paper P. The seven suction mechanisms 74 are configured such that whether or not to perform suctioning is switchable, and whether or not to perform suctioning is controlled based on a control signal input from the ink drying control portion 120.

[Drying Properties of Paper]

Next, the drying properties of the paper will be described. For an experiment of the drying properties, three kinds of paper were prepared.

Paper I: "OK TOPCOAT+", basis weight: 104 [g/$m^2$] (manufactured by Oji Paper Co., Ltd.)

Paper II: "OK TOPCOAT+", basis weight: 127 [g/$m^2$] (manufactured by Oji Paper Co., Ltd.)

Paper III: "IBEST W", basis weight: 310 [g/$m^2$] (manufactured by Nippon Paper Industries Co., Ltd.)

Here, the basis weight refers to the weight of one sheet of paper per unit area.

[Step 1] The water content in the paper was measured before the experiment.

The humidity of each of the papers I, II, and III was controlled (the paper was left to stand) in advance in a laboratory environment (temperature: 23 [° C.], relative humidity 50 [% RH]) for one day.

In order to measure the water content in each paper, first, the paper was punched (cut) into a measurement portion having a size of 3 [cm]×3 [cm], and the water content in the measurement portion was measured using a trace moisture measuring device CA-200 (manufactured by Mitsubishi Chemical Analytech Co., Ltd.). Next, the measurement water content [g] was divided by the punched area to calculate the water content per unit area [g/$m^2$]. The water content of each paper after humidity control is described below.

Paper I: 5.8 [g/$m^2$]

Paper II: 7.1 [g/$m^2$]

Paper III: 18.0 [g/$m^2$]

[Step 2] Ink was jetted (applied) to each paper using an ink jet head.

The jetting density of the ink, the ink formulation, and the like are described below. The details of the ink can be found in, for example, JP2013-146965A.

Figure 7A:
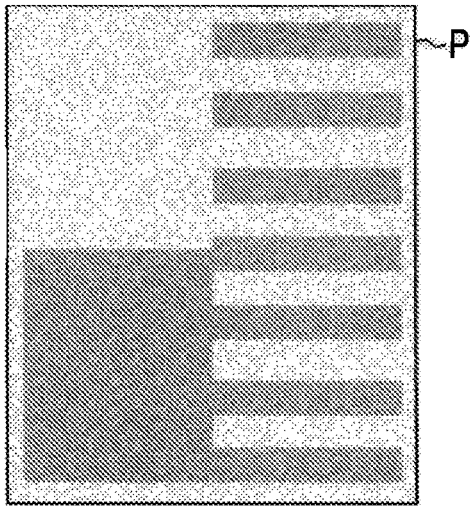
FIGS. 7A to 7C are diagrams showing waving and wrinkling occurring in paper.

(Jetting Density): 1200 [dpi]×1200 [dpi]

the positions shown in FIG. 7A, and irradiating the paper P with observation light in the horizontal direction from the back surface of the jetted surface of the paper P. In this paper P, waving occurred. Waving refers to a state where local unevenness occurs in the paper P because paper fibers swell due to the water in the ink jetted to the paper P.

| (Ink Formulation) | |
|---|---|
| Pigment Blue 15:3 (cyan [pigment) | 2.5 [mass %] |
| Water-insoluble polymer dispersant P-1 (solid content) | 1.25 [mass %] |
| Self-dispersing polymer particles A-01 (solid content) | 8.0 [mass %] |
| SANNIX GP-250 | 10.0 [mass %] (average molecular weight: 250, manufactured by Sanyo Chemical Industries Ltd.) |
| TPGmME | 4.0 [mass %] (tripropylene glycol monomethyl ether; hereinafter, the same shall be applied) |
| DPG (dipropylene glycol; hereinafter, the same shall be applied) | 4.0 [mass %] |
| OLFINE E1010 (surfactant, manufactured by Nissin Chemical Co., Ltd.) | 1.0 [mass %] |
| Urea | 5.0 [mass %] |
| SNOWTEX XS (manufactured by Nissan Chemical Industries Ltd., colloidal silica) | 0.3 [mass %] |
| Ion exchange water | 63.95 [mass %] |

(ink jetting amount: 11.4 [g/m$^2$])
(water content in jetted ink: 7.3 [g/m$^2$])

[Step 3] The paper to which the ink was jetted was heated using an IR lamp and warm air for a predetermined period of time.

Figures 4, 5:
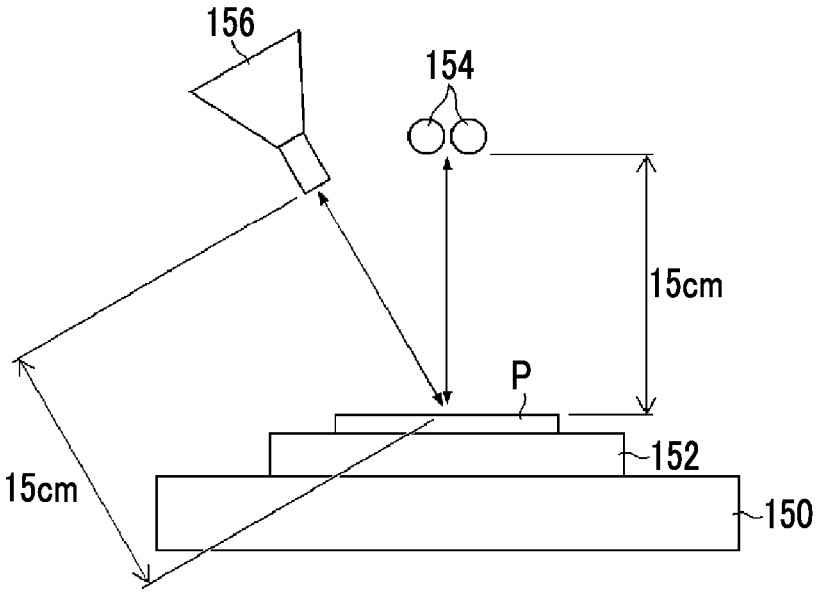
FIG. 4 is a diagram showing conditions of an experiment for drying properties of paper.
FIG. 5 is a table showing the results of the experiment for drying properties of paper.

As shown in FIG. 4, a heat insulator 152 was placed on a laboratory table 150, and the paper P to which the ink was jetted was placed on the heat insulator 152 such that the jetted surface faces upward (opposite to the heat insulator 152). As described above, the paper P was punched into a portion having a size of 3 [cm]×3 [cm].

In addition, IR lamps 154 and a warm air unit 156 were disposed at a position at a distance of 15 [cm] from the jetted surface of the paper P. As the IR lamps 154, two carbon heaters CRS 1000/300G (maximum output: 1000 [W]) were used. In addition, in the warm air unit 156, the air flow rate was set as 10 [m/s], the outlet nozzle was set as 5 [cm]×1 [cm], and the air temperature was set as 70 [° C.].

In the above-described device configuration, the paper was heated for a predetermined period of time and was removed from the laboratory table 150. At this time, the water content in the paper was measured. Here, a value obtained by subtracting the water content in the paper before heating (before humidity control) from the measured water content in the paper is defined as the residual water content.

Figure 6:
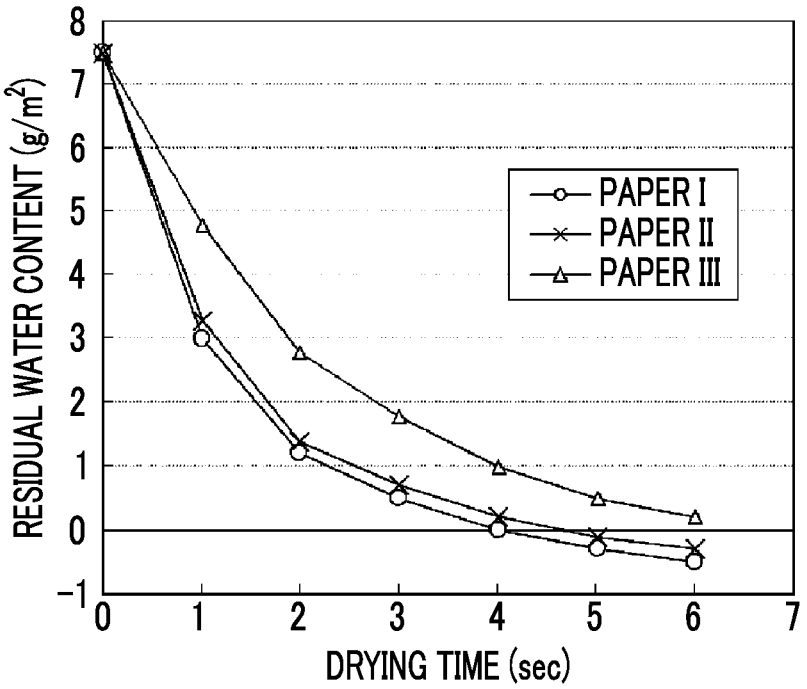
FIG. 6 is a graph showing the results of the experiment for drying properties of paper.

FIGS. 5 and 6 shows the residual water contents which varied depending on the heating time of each paper. A condition where the residual water content is a negative value refers to a condition where the water content after drying was lower than the water content before ink jetting.

In addition, it was found that, in any of papers, the surface (jetted surface) was dried to the set-to-touch state by setting the residual water content to be 0.7 [g/m$^2$] or lower. A paper having a large basis weight [g/m$^2$] is likely to be difficult to dry, but all the papers can be dried.

<Paper Drying in Ink Drying Portion>

Here, waving and wrinkling which occur in the paper P will be described in FIGS. 7A to 7C. FIG. 7A is a diagram showing ink jetting positions of the paper P when seen from the back surface of the jetted surface of the paper P. Gray portions shown in FIG. 7A are ink jetting positions on the back surface side.

Figure 7B:
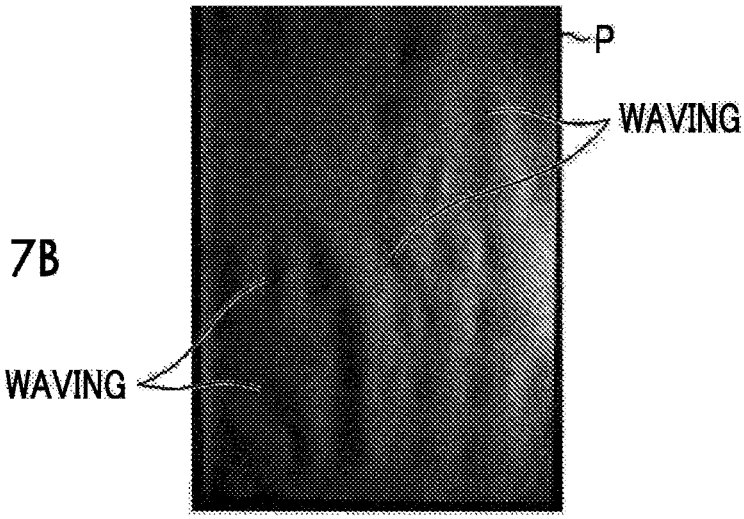
Figure 7C:
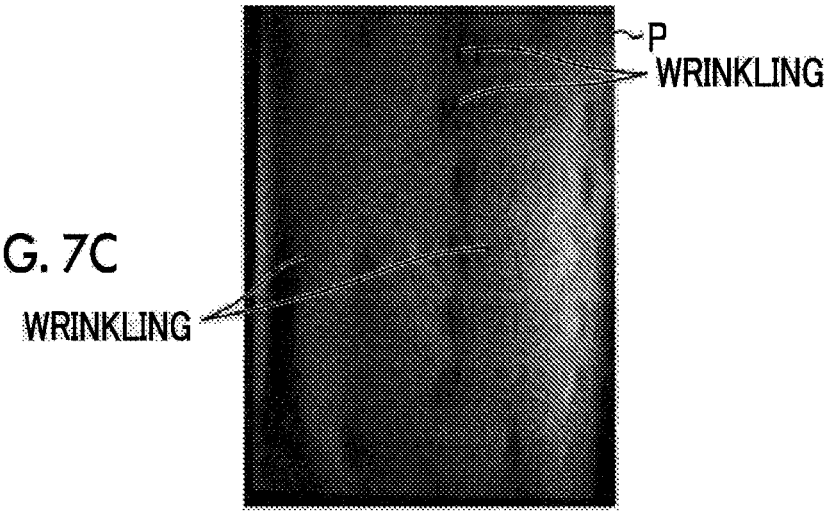

FIG. 7B is an image which was obtained using a still camera after drying the paper, to which the ink was jetted at FIG. 7C is an image which was obtained using a still camera after drying the paper, to which the ink was jetted at the positions shown in FIG. 7A, and irradiating the paper P with observation light in the horizontal direction from the back surface of the jetted surface of the paper P. In this paper P, wrinkling occurred. Wrinkling is unevenness which is smaller than waving and refers to small deformation is fixed due to the water in the ink.

Next, when the paper P is dried in the ink drying portion 20, a relationship between the suction of the paper P in the suction mechanism 74 and the occurrence of waving and wrinkling will be described.

As the kinds of the paper P, Papers I, II, and III described above were used. The paper size was set as 750 [mm]×532 [mm]. As ink jetting conditions, stripes were printed on each paper (refer to FIG. 7A). The printed paper P was transported by the chain gripper 64 such that the grippers 64D of the chain grippers 64 gripped the long side of the paper P and the short side of the paper P was parallel to the transport direction of the paper P. At this time, the grain of the paper P was horizontal. That is, the grain of the paper P was in a direction parallel to the long side.

The conduction duty of the IR unit 68H was set as a set value (heating amount) varying depending on the basis weight of the paper P such that the residual water content in the paper P having passed through the ink drying portion 20 was appropriate, that is, was equal to or lower than 0.7 [g/m$^2$] as the residual water content in the paper dried to the set-to-touch state. Specifically, the conduction duty of the paper I was set as 30%, the conduction duty of the paper II was set as 40%, and the conduction duty of the paper III was set as 80% The conduction duty of the IR unit 68H can be controlled by the ink drying control portion 120.

Here, in the ink drying portion 20, the paper was transported while being suctioned by some of the seven suction mechanisms 74 which were provided on the upstream side and not being suctioned by the other suction mechanisms 74 which were provided on the downstream side. Boundaries between the upstream side and the downstream side, that is, suction stop positions were set at positions including a position R1, a position R2, . . . , and a position R6 shown in FIG. 3. Waving and wrinkling occurring in the paper P in each case were evaluated by visual inspection. The evaluation criteria are as follows.

"Waving"

Very Good: Substantially no waving occurred

Good: waving occurred slightly but caused no problem in quality

Bad: waving occurred strongly and caused a problem in quality.

"Wrinkling"

Very Good: Substantially no wrinkling occurred

Good: wrinkling occurred slightly but caused no problem in quality

Bad: wrinkling occurred strongly and caused a problem in quality.

FIG. 8 shows the evaluation results of the occurrence of waving and wrinkling which varied depending on the respective suction stop positions in each paper. Regarding "Residual Water Content in Suction Stop Position" in FIG. 8, in order to exclude the effect of the drying of the downstream side of the suction stop position, the measurement was performed by transporting the paper after the IR unit 68H and the warm air unit 68F positioned downstream of the suction stop position was stopped.

As shown in FIG. 8, regarding the paper I, at the position R1 as the suction stop position, waving was strong and caused a problem in quality. In addition, at the position R2 as the suction stop position, waving occurred slightly but caused no problem in quality. In a region after the position R3 as the suction stop position, no waving occurred. In addition, in a region before the position R3 as the suction stop position, no wrinkling occurred. However, at the position R4 as the suction stop position, wrinkling occurred slightly, and in a region after the position R5, wrinkling occurred strongly. At the position R6, the residual water content was 0.5 [g/m$^2$] which was lower than 0.7 [g/m$^2$] as the residual water content in the paper dried to the set-to-touch state. Therefore, it can be seen that the paper P can be sufficiently dried by drying the paper P while transporting to the position R6.

It can be seen from the above result that, in the paper I, the occurrence of waving and wrinkling can be prevented by setting the suction stop position at the position R2, the position R3, or the position R4. Here, the residual water contents at the suction stop positions were 3.0 [g/m$^2$] at the position R2, 1.5 [g/m$^2$] at the position R3, and 1.0 [g/m$^2$] at the position R4.

Accordingly, when the paper I was dried while being transported, a region before a specific position in which the residual water content in the paper I was 1.0 [g/m$^2$] to 3.0 [g/m$^2$] was set as a suction region where the paper I was suctioned by the suction mechanism 74, and a region after the specific position was set as a non-suction region. As a result, the occurrence of waving and wrinkling was able to be prevented.

Likewise, regarding the paper II, at the position R1 as the suction stop position, waving was strong and caused a problem in quality. In addition, at the position R2 as the suction stop position, waving occurred slightly but caused no problem in quality. In a region after the position R3 as the suction stop position, no waving occurred. In addition, in a region before the position R3 as the suction stop position, no wrinkling occurred. However, at the position R4 as the suction stop position, wrinkling occurred slightly, and in a region after the position R5, wrinkling occurred strongly. At the position R6, the residual water content was 0.4 [g/m$^2$] which was lower than 0.7 [g/m$^2$] as the residual water content in the paper dried to the set-to-touch state. Therefore, it can be seen that the paper P can be sufficiently dried by drying the paper P while transporting to the position R6.

It can be seen from the above result that, in the paper II, the occurrence of waving and wrinkling can be prevented by setting the suction stop position at the position R2, the position R3, or the position R4. Here, the residual water contents at the suction stop positions were 3.0 [g/m$^2$] at the position R2, 1.4 [g/m$^2$] at the position R3, and 1.0 [g/m$^2$] at the position R4.

Accordingly, when the paper II was dried while being transported, a region before a specific position in which the residual water content in the paper II was 1.0 [g/m$^2$] to 3.0 [g/m$^2$] was set as a suction region where the paper II was suctioned by the suction mechanism 74, and a region after the specific position was set as a non-suction region. As a result, the occurrence of waving and wrinkling was able to be prevented.

In addition, in the paper III, waving and wrinkling did not occur irrespective of the suction stop positions. Problems of waving and wrinkling occurs in a paper having a basis weight of 150 [g/m$^2$] or less.

Accordingly, the following can be seen from the above results. When the paper I was dried while being transported, a region before a specific position in which the residual water content in the paper I was 1.0 [g/m$^2$] to 3.0 [g/m$^2$] was set as a suction region where the paper I was suctioned by the suction mechanism 74, and a region after the specific position was set as a non-suction region. As a result, the occurrence of waving and wrinkling was able to be prevented.

Accordingly, in the ink drying portion 20 of the ink jet recording apparatus 10, the suction stop position (an example of the first position) is fixed to, for example, the position R3, a region provided upstream (image recording portion 18 side) of the position R3 in the transport path of the paper P is set as a suction region where the paper P is suctioned by the suction mechanism 74 (an example of the suction step), and a region provided downstream (the paper discharge portion 24 side) of the R3 position in the transport path of the paper P is set as a non-suction region where the paper P is not suctioned. In this state, the paper P is guided using the guide surface of the guide plate 72 (an example of the guide step). Next, while being transported (an example of the transport step), the paper P is heated after adjusting the conduction duty of the IR unit 68H depending on the basis weight of the paper P (an example of the heating step). As a result, the paper P is dried (an example of the drying step). Here, when passing through the position R3, the residual water content in the paper P may be set to be 1.0 [g/m$^2$] to 3.0 [g/m$^2$].

In addition, after fixing the conduction duty to a certain value for each paper, a position where the residual water content in the paper P is 1.0 [g/m$^2$] to 3.0 [g/m$^2$] may be set as the suction stop position. For example, it is thought that the position where the residual water content in the paper P is 1.0 [g/m2] to 3.0 [g/m2] varies depending on the basis weight of the paper P. Therefore, the suction stop position may be changed depending on the basis weight of the paper P.

Further, a configuration can be adopted in which, after acquiring information regarding the basis weight of the paper P, in a case where the basis weight is 150 [g/m$^2$] or less, the suction stop position is set, and in a case where the basis weight is more than 150 [g/m$^2$], the paper P is suctioned at all the positions of the guide plate 72.

The control of the suction stop positions can be realized by the transport control portion 110 controlling whether to perform suction using each suction mechanism 74.

In this way, in the embodiment, an image is formed on the paper P using an aqueous ink by the ink jet heads 200C, 200M, 200Y, and 200K; the paper P is dried by being heated the IR unit 68H and the warm air unit 68F while being transported along the transport path by the chain grippers 64; the region of the guide plate 72 provided upstream of the suction stop position is set as the suction region where the paper P is suctioned by the suction mechanism 74, and the region provided downstream of the suction stop position is set as the non-suction region; and the suction stop position is set as a position where the residual water content in the paper P is 1.0 [g/m$^2$] to 3.0 [g/m$^2$] (an example of the ink jet recording method).

In the embodiment, configuration examples of "the non-suction region" include a configuration in which the paper P is not suctioned at all the positions by not operating the suction mechanism 74, a configuration in which the suction holes are not provided in the guide plate 72, and a configuration in which substantially the same effects as those of the above-described configurations are generated. For example, a region where the paper P is suctioned to a small degree (suction pressure: 30 [Pa] or lower) that the paper is not fixed is also included in the configuration of "the non-suction region" according to the embodiment.

<Regarding Paper>

In the paper P used in the embodiment, waving and wrinkling occur when printing is performed using an aqueous ink by an ink jet method. As the paper P, common printing paper (paper containing cellulose as a major component, for example, so-called high-quality paper, coated paper, or art paper) used in general offset printing or the like can be used. In addition, coated paper in which a coating layer is provided by applying a coating material to a non-treated surface of high-quality paper or alkaline paper can also be used.

<Regarding Ink Composition>

The embodiment is effectively applied in a case where an image is formed on common paper using an aqueous ink by an ink jet method Here, an example of the composition of the aqueous ink used in the embodiment will be described.

The aqueous ink used in the embodiment includes at least a colorant, resin particles, and water. In addition, the aqueous ink used in the embodiment optionally further includes a water-soluble organic solvent, a dispersant, a surfactant and other components.

[Colorant]

The aqueous ink includes at least one colorant. As the colorant, for example, various well-known dyes and pigments can be used without any particular limitation. Among these, a colorant which has substantially no solubility or low solubility in water is preferably used from the viewpoint of ink colorability. Specific examples of the colorant include various pigments, disperse dyes, oil-soluble dyes, and colorants which form a J-aggregate. Among these, a pigment is more preferable.

In the embodiment, a water-insoluble pigment, or a pigment which is surface-treated by a dispersant can be used as the colorant.

As the pigment, well-known organic and inorganic pigments of the related art can be used without any particular limitation in kind. Examples of the pigment include: an azo lake pigment, an azo pigment, a phthalocyanine pigment, a perylene pigment, and a perinone pigment; a polycyclic pigment such as an anthraquinone pigment, a quinacridone pigment, a dioxazine pigment, a diketo pyrrolo pyrrole pigment, a thioindigo pigment, an isoindolinone pigment, or a quinophthalone pigment; a dye lake such as a basic dye lake or an acid dye lake; an organic pigment such as a nitro pigment, a nitroso pigment, Aniline Black, or a daylight fluorescent pigment; and an inorganic pigment such as titanium oxide, iron oxide, or carbon black.

[Resin Particles]

The aqueous ink used in the embodiment includes at least one kind resin particles having a minimum film-forming temperature (MFT0) of 60 [° C.] when used in the form of a water dispersion. The aqueous ink may include resin particles having MFT0 of lower than 60 [° C.]. However, in a case where MFT0 of all the resin particles in the aqueous ink is lower than 60 [° C.], the formed image is sticky, and thus blocking occurs when paper or the like is stacked on the image portion. In the embodiment, MFT0 is preferably 80 to 150 [° C.] and more preferably 100 to 130 [° C.]. In a case where MFT0 is lower than 150° C., the amount of heat required during thermal fixing may be small, which is preferable from the viewpoint of energy saving during fixing.

Examples of the resin particles includes particles of various resins including: a thermoplastic, thermosetting, or thermally modified resin such as an acrylic resin, an epoxy resin, a polyurethane resin, a polyether resin, a polyamide resin, an unsaturated polyester resin, a phenol resin, a silicone resin, or a fluororesin, a polyvinyl resin such as vinyl chloride, vinyl acetate, polyvinyl alcohol, or polyvinyl butyral; a polyester resin such as an alkyd resin or a phthalic acid resin; an amino material such as a melamine resin, a melamine formaldehyde resin, an amino-alkyd co-condensate resin, or a urea resin; and a resin having an anionic group such as a copolymer or a mixture of the above-described resins.

[Water-Soluble Organic Solvent]

In order to prevent drying, to promote water permeation, and to adjust the viscosity, it is preferable that the aqueous ink used in the embodiment include a water-soluble organic solvent. In addition, by the aqueous ink including the water-soluble organic solvent, MTF of the resin particles of the ink can be maintained at a low level, which is preferable from the viewpoint of maintaining excellent jettability or the like. In addition, in order to prevent drying, to promote water permeation, and to adjust the viscosity, the aqueous ink optionally includes other organic solvents.

In a case where an organic solvent is used as an anti-drying agent, nozzle clogging, which may occur by the ink being dried at an ink jetting opening when the ink is jetted using an ink jet method to form an image, can be effectively prevented.

In order to prevent drying, it is preferable that the water-soluble organic solvent has a lower vapor pressure than water. Specific examples of the water-soluble organic solvent which is preferable to prevent drying include: a polyhydric alcohol such as ethylene glycol, propylene glycol, diethylene glycol, polyethylene glycol, thiodiglycol, dithiodiglycol, 2-methyl-1,3-propanediol, 1,2,6-hexanetriol, an acetylenic glycol derivative, glycerin, or trimethylolpropane; a heterocycle such as 2-pyrrolidone, N-methyl-2-pyrrolidone, 1,3-dimethyl-2-imidazolidinone, or N-ethylmorpholine; a sulfur-containing compound such as sulfolane, dimethyl sulfoxide, or 3-sulfolane; a polyfunctional compound such as diacetone alcohol or diethanolamine; and a urea derivative. Among these, a polyhydric alcohol such as glycerin or diethylene glycol is preferable.

In addition, in order to promote the permeation of the ink into the recording medium, an organic solvent may be used. Preferable specific examples of the organic solvent for promoting the permeation include an alcohol such as ethanol, isopropanol, butanol, or 1,2-hexanediol, sodium lauryl sulfate, sodium oleate, and a nonionic surfactant.

In addition, in addition to the above-described purpose, the water-soluble organic solvent can be used in order to adjust the viscosity. Specific examples of the water-soluble organic solvent which can be used to adjust the viscosity include an alcohol (for example, methanol, ethanol, or propanol), an amine (for example, ethanolamine, diethanolamine, triethanolamine, ethylenediamine, or diethylenetriamine), and other polar solvents (for example, formamide, N,N-dimethylformamide, N,N-dimethylacetamide, dimethyl sulfoxide, sulfolane, 2-pyrrolidone, acetonitrile, or acetone).

[Water]

The aqueous ink used in the embodiment includes water, and the water content is not particularly limited. The water content is preferably 10 to 99 [mass %], more preferably 30 to 80 [mass %], and still more preferably 50 to 70 [mass %].

[Other Additives]

In addition to the above-described components, optionally, the aqueous ink used in the embodiment can include other additives. Examples of the other additives include well-known additives such as an anti-fading agent, an emulsion stabilizer, a penetration enhancer, a ultraviolet absorber, a preservative, a fungicide, a pH adjuster, a surface tension adjuster, an anti-foaming agent, a viscosity adjuster, a dispersant, a dispersion stabilizer, a rust inhibitor, or a chelating agent. These various additives may be directly added after the preparation of the ink or during the preparation of the ink.

The surface tension of the ink is preferably 20 to 60 [mN/m], more preferably 20 to 45 [mN/m], and still more preferably 25 to 40 [mN/m]. On the other hand, in a case where the ink is applied using a method other than an ink jet method, the surface tension of the ink is preferably in a range of 20 to 60 [mN/m] and more preferably in a range of 30 to 50 [mN/m].

The surface tension of the ink is measured using Automatic Surface Tensiometer CBVP-Z (manufactured by Kyowa Interface Science Co., Ltd.) by a plate method under conditions of 25 [° C.]

In a case where the ink is applied using an ink jet method, from the viewpoints of jetting stability and an aggregation rate of the ink during contact between the ink and the treatment liquid, the ink viscosity is preferably in a range of 1 to 30 [mPa·s], more preferably in a range of 1 to 20 [mPa·s], still more preferably in a range of 2 to 15 [mPa·s], and even still more preferably in a range of 2 to 10 [mPa·s].

In addition, in a case where the ink is applied using a method other than an ink jet method, the ink viscosity is preferably in a range of 1 to 40 [mPa·s] and more preferably in a range of 5 to 20 [mPa·s].

The ink viscosity can be measured using, for example, a Brookfield viscometer.

The technical scope of the present invention is not limited to the ranges described in the above-described embodiment. The configurations and the like in the respective embodiments can be appropriately combined with each other within a range not departing from the scope of the present invention.

EXPLANATION OF REFERENCES

10: ink jet recording apparatus
20: ink drying portion
64: chain gripper
64A: first sprocket
64B: second sprocket
64C: chain
64D: gripper
68: ink drying unit
68F: warm air unit
68H: IR unit
72: guide plate
74: suction mechanism
76: constant-temperature chiller
120: ink drying control portion
150: laboratory table
152: heat insulator
154: IR lamp
156: warm air unit
P: paper

What is claimed is:

1. An ink jet recording apparatus comprising:

an image recording portion that forms an image on a recording surface of a sheet of paper by an ink jet method using an aqueous ink including a solvent and water; and an ink drying portion that dries the paper while transporting the paper having the recording surface on which the image is formed, wherein the ink drying portion includes, a transport unit that grips a leading end of the paper and transports the paper along a transport path, a heating unit that is provided along the transport path and heats the recording surface of the paper which is transported, a guide unit that is provided along the transport path and supports the paper, which is transported, from a surface of the paper opposite to the recording surface using a guide surface having suction holes, and a suction unit that suctions the paper through the suction holes of the guide surface, wherein the ink drying portion transports the paper by setting upstream of a first position of the transport path as a suction region in which the paper is suctioned by the suction unit, and downstream of the first position as a non-suction region, and the first position is set at a position in which a residual water content in the paper is 1.0 $g/m^2$ to 3.0 $g/m^2$, and the ink drying portion dries the paper until the residual water content in the paper is 0.7 $g/m^2$ or less downstream of the first position.

2. The ink jet recording apparatus according to claim 1, wherein the ink drying portion adjusts a heating amount of the heating unit according to the weight of the paper per unit area.

3. The ink jet recording apparatus according to claim 1, wherein the guide unit includes temperature control unit that controls a temperature of the guide surface.

4. The ink jet recording apparatus according to claim 2, wherein the guide unit includes temperature control unit that controls a temperature of the guide surface.

5. The ink jet recording apparatus according to claim 1, wherein the transport unit is a chain gripper.

6. The ink jet recording apparatus according to claim 2, wherein the transport unit is a chain gripper.

7. The ink jet recording apparatus according to claim 1, wherein the heating unit includes an infrared heater or a warm air unit.

8. The ink jet recording apparatus according to claim 2, wherein the heating unit includes an infrared heater or a warm air unit.

9. The ink jet recording apparatus according to claim 3, wherein the heating unit includes an infrared heater or a warm air unit.

10. An ink jet recording method comprising:

an image recording step of forming an image on a recording surface of a sheet of paper by an ink jet method using an aqueous ink including a solvent and water; and an ink drying step of drying the paper having the recording surface on which the image is formed while transporting the paper, wherein the ink drying step includes a transporting step of gripping a leading end of the paper and transporting the paper along a transport path, a heating step of heating the recording surface of the paper which is transported, a guide step of supporting the paper, which is transported, from a surface of the paper opposite to the recording surface using a guide surface having suction holes, and a suction step of suctioning the paper through the suction holes of the guide surface, in the ink drying step, the paper is transported by setting upstream of a first position of the transport path as a suction region in which the paper is suctioned in the suction step and downstream of the first position as a non-suction region, and the first position is set at a position in which a residual water content in the paper is 1.0 $g/m^2$ to 3.0 $g/m^2$, and in the ink drying step, the paper is dried until the residual water content in the paper is 0.7 $g/m^2$ or less downstream of the first position.

11. The ink jet recording method according to claim 10, wherein in the ink drying step, a heating amount in the heating step is adjusted according to the weight of the paper per unit area.

* * * * *